US008186695B2

(12) United States Patent
Møller

(10) Patent No.: US 8,186,695 B2
(45) Date of Patent: May 29, 2012

(54) COMFORT WHEELCHAIR

(75) Inventor: Flemming Møller, Horsens (DK)

(73) Assignee: R82 A/S, Gedved (DK)

( * ) Notice: Subject to any disclaimer, the term of this patent is extended or adjusted under 35 U.S.C. 154(b) by 993 days.

(21) Appl. No.: 11/666,568

(22) PCT Filed: Oct. 27, 2005

(86) PCT No.: PCT/DK2005/000691

§ 371 (c)(1),
(2), (4) Date: Aug. 10, 2007

(87) PCT Pub. No.: WO2006/045316

PCT Pub. Date: May 4, 2006

(65) Prior Publication Data

US 2008/0157501 A1 Jul. 3, 2008

(30) Foreign Application Priority Data

Oct. 29, 2004 (DK) ..... 2004 01668
Mar. 4, 2005 (DK) ..... 2005 00325

(51) Int. Cl.
*A61G 5/00* (2006.01)
*A61G 5/10* (2006.01)

(52) U.S. Cl. ..... 280/47.4; 280/47.25; 280/47.38; 280/47.41; 280/647; 280/650

(58) Field of Classification Search ..... 280/47.25, 280/47.38, 47.4, 47.41, 79.2, 250.1, 304.1, 280/647, 648, 650; 297/DIG. 4, 30, 68–70, 297/411.38, 316–318, 340–342, 328, 337, 297/362; 180/907

See application file for complete search history.

(56) References Cited

U.S. PATENT DOCUMENTS 185,189 A * 12/1876 Platt ..... 297/362
349,063 A * 9/1886 Shepard ..... 297/342

(Continued)

FOREIGN PATENT DOCUMENTS

DE 10013564 8/2001

(Continued)

*Primary Examiner* — J. Allen Shriver, II
*Assistant Examiner* — Travis Coolman
(74) *Attorney, Agent, or Firm* — James Creighton Wray

(57) ABSTRACT

A wheelchair comprising a chassis, which has a lower chassis section pivotally connected to an upper chassis section, such that the upper chassis section can pivot in relation to the lower chassis section about a substantially horizontal axis;

where said lower section comprises two substantially parallel load carrying members, oriented in a direction parallel to the intended travelling direction of the wheelchair;

where the load carrying members are spaced in a direction perpendicular to the travelling direction by at least one transverse member;

where the rear wheels can be detachably mounted where the transverse member intersects each of the load carrying members;

and where close to, or as a part of, the mechanism pivotally connecting the upper and lower section, front wheels can be attached, said wheel mounting being pivotable about a vertical axle;

where a seat can be slidingly attached to the upper chassis section, and the seat further can be pivoted about a horizontal axis.

11 Claims, 13 Drawing Sheets

U.S. PATENT DOCUMENTS 538,708 A * 5/1895 Smith ..... 297/368
3,189,385 A * 6/1965 Mommsen ..... 297/423.26
3,191,990 A * 6/1965 Rugg et al. ..... 297/83
3,337,261 A * 8/1967 Nihlean et al. ..... 297/44
3,566,986 A * 3/1971 Udden ..... 180/21
3,574,399 A * 4/1971 Udden ..... 297/423.37
3,580,591 A * 5/1971 Coffey et al. ..... 280/5.32
3,848,883 A * 11/1974 Breacain ..... 280/5.32
3,858,938 A * 1/1975 Kristensson et al. .... 297/423.19
3,883,175 A * 5/1975 Rodaway ..... 297/411.28
4,486,048 A * 12/1984 Meyer ..... 297/423.33
4,544,200 A * 10/1985 Dunn et al. ..... 297/265.1
4,632,450 A * 12/1986 Holdt ..... 297/84
4,655,501 A * 4/1987 Ishigami et al. ..... 297/113
4,709,965 A * 12/1987 Kazaoka et al. ..... 297/366
4,893,826 A * 1/1990 Ward et al. ..... 280/87.021
4,893,827 A * 1/1990 Gay et al. ..... 280/250.1
4,946,226 A * 8/1990 Hurn et al. ..... 297/411.38
4,966,379 A * 10/1990 Mulholland ..... 280/242.1
5,033,793 A * 7/1991 Quintile ..... 297/423.33
5,044,647 A * 9/1991 Patterson ..... 280/250.1
5,163,734 A * 11/1992 Hakansson ..... 297/330
5,180,025 A * 1/1993 Yeh et al. ..... 180/65.51
5,205,609 A * 4/1993 Notta et al. ..... 297/367 R
5,240,277 A * 8/1993 Scheulderman ..... 280/650
5,328,247 A * 7/1994 Lovins ..... 297/423.3
5,356,172 A * 10/1994 Levy et al. ..... 280/650
5,540,297 A * 7/1996 Meier ..... 180/65.51
5,575,348 A * 11/1996 Goertzen et al. ..... 180/65.6
5,673,967 A * 10/1997 Wempe ..... 297/68
5,727,802 A * 3/1998 Garven et al. ..... 280/250.1
5,853,059 A * 12/1998 Goertzen et al. ..... 180/65.6
5,971,482 A * 10/1999 Goertzen et al. ..... 297/329
5,984,416 A * 11/1999 Waldo et al. ..... 297/411.38
6,032,976 A * 3/2000 Dickie et al. ..... 280/650
6,105,706 A 8/2000 Cooper et al.
6,168,238 B1 * 1/2001 Hannagan ..... 297/423.3
6,206,393 B1 * 3/2001 Mascari et al. ..... 280/220
6,325,455 B1 * 12/2001 Chung ..... 297/327
6,390,554 B1 * 5/2002 Eakins et al. ..... 297/317
6,409,265 B1 * 6/2002 Koerlin et al. ..... 297/325
6,425,635 B1 * 7/2002 Pulver ..... 297/343
6,450,581 B1 * 9/2002 Koerlin ..... 297/423.26
6,609,758 B1 * 8/2003 Lefevere ..... 297/411.38
6,769,705 B1 * 8/2004 Schlangen ..... 280/250.1
6,913,318 B2 * 7/2005 Higley et al. ..... 297/383
6,976,699 B2 * 12/2005 Koerlin ..... 280/650
7,007,965 B2 * 3/2006 Bernatsky et al. ..... 280/304.1
7,066,543 B2 * 6/2006 Yu ..... 297/378.12
7,150,463 B1 * 12/2006 Liao ..... 280/124.128
7,243,935 B2 * 7/2007 Beumer ..... 280/250.1
7,360,840 B2 * 4/2008 Barlow et al. ..... 297/423.26
7,367,578 B2 * 5/2008 Jansen ..... 280/304.1
2003/0075967 A1 * 4/2003 Ciolfe et al. ..... 297/423.32
2004/0080190 A1 * 4/2004 Markwald ..... 297/61
2004/0188979 A1 * 9/2004 Bernatsky et al. ..... 280/304.1
2005/0017561 A1 * 1/2005 Burmeister et al. ..... 297/354.12
2006/0012148 A1 * 1/2006 Melgarejo et al. ..... 280/304.1

FOREIGN PATENT DOCUMENTS

DE 20303000 8/2003
DK 199800185 2/1999
EP 1226803 7/2002
FR 2749502 12/1997
WO WO 2004/065173 8/2004

* cited by examiner

COMFORT WHEELCHAIR

This application claims the benefit of Danish Application No. PA 2004 01668 filed Oct. 29, 2004, Danish Application No. PA 2005 00325 filed Mar. 4, 2005, and PCT/DK2005/000691 filed Oct. 27, 2005, which are hereby incorporated by reference in their entirety.

FIELD OF THE INVENTION

The present invention relates to a wheelchair optionally having different accessories. This type of device usually belongs to the field of wheelchairs in general and especially for support material for handicapped people.

BACKGROUND OF THE INVENTION

Conventional wheelchairs provide equipment for use by disabled persons in order to be mobile and to increase the opportunities of disabled persons to participate more fully in daily activities. Conventional wheelchairs are typically manufactured of metal tubes which are cut to length, bent into shape, and welded together to form a tubular frame that supports a seat and back. Wheels connected to the frame provide mobility. Push handles attach to the back of the frame for pushing the wheelchair or controlling its direction of the movement. The purpose of wheelchairs is to provide equipment which solves disability-related problems, so that disabled persons can more easily participate in everyday life activities while minimizing the problems created by the equipment.

Generally, wheelchairs for profoundly immobilized persons are custom-built using specific measurements of the particular person to use the wheelchair. The measurements are used to determine the particular width, depth, and height of tie frame, the seat, and the seat back for the wheelchair. Because of the many combinations of sizes, it is expensive to maintain inventories of specific sized component parts. Accordingly, manufacturers of wheelchairs cut elongated tubular members to size based on a customized specification for the particular individual. The tubes are assembled into a frame of a specific design. Production of an individual wheelchair is complex and slow because custom parts have to be manufactured. Also, due to personalized customization of the dimensions of a wheelchair, it is not practical to maintain inventories of completed frames. Similarly, the large number of variations and combinations pre-vent retailers of wheelchairs from holding wheelchairs in inventory. Further, there often is a lag time of many weeks between ordering a custom wheelchair and delivery of the wheelchair to the user.

During manufacture, the frame members are typically joined together by welding. The seats, backs, pads, push handles and wheels are then conventionally connected to the frame using clamps, tubular connectors, latches, and bolts with nuts. While these secure the components to the frame, the connectors must be loosened, removed, and repositioned for adjusting the orientation and position of the components. For aides to wheelchair users who are not skilled in mechanics, operation of these connectors may be difficult, awkward, and frustrating. Also, the connectors must be loosened or removed in order to disassemble the wheelchair for transport in cars.

Further, the tubular frame and various connectors make conventional wheelchairs difficult to "grow" in order to accommodate the physical growth of the user as well as accommodate the different situations that a user will be exposed to during daily life. Among these situations can be the need to be able to fit under a table, gain access to a sink, reach for things in cupboards, change the comfort position for typing, watching television, engage in conversation and the like.

From U.S. Pat. No. 5,727,802 a wheelchair is known which has an upper and a lower frame. At the rear of the wheelchair a shock absorber is provided arranged between the upper and lower frames. A pivotal connection is provided at a connection point between the upper and lower frames in the front end of the wheelchair. In this manner a certain amount of shock absorption is built into the construction.

Disabled persons who look to wheelchairs for mobility also are dependent on the wheelchair for bodily support. It is important that the wheelchair be lightweight and easily maneuverable, in order to conserve the energy of the person. Also, the seat and back should be easily adjustable to provide proper posture and comfort. Improper seating is not only uncomfortable but may create additional physical problems for the person using the chair. The width, height, depth, and tilt of the seat as well as the width, height, and tilt angle of the back of the seat, affect proper seating. Proper adjustments of the seating variables, together with proper sizing of the wheelchair contributes to a more neutral skeletal alignment and may impede the progression of skeletal deformities and muscle contracture, better manage seating pressures and reducing the potential for pressure sores, improve the seating stability of the occupant, increase sitting tolerance through increased comfort, and decrease fatigue. The tubular frame however often interferes with attachment and adjustment of the pads and abductors which may be critical to properly supporting the user in the wheelchair.

Accordingly, there is a need in the art for improved wheelchairs that are readily assembled, disassembled, adjusted, and used for and by disabled persons. It is to such that the present invention is directed.

SUMMARY OF THE INVENTION

The present invention provides an improved wheelchair comprising a chassis, which has a lower chassis section pivotally connected to an upper chassis section, such that the upper chassis section can pivot in relation to the lower chassis section about a substantially horizontal axis;

where said lower section comprises two substantially parallel load carrying members, oriented in a direction parallel to the intended travelling direction of the wheelchair;

where the load carrying members are spaced in a direction perpendicular to the travelling direction by at least one transverse member;

where means are provided for detachably mounting rear wheels where the trans-verse member intersects each of the load carrying members;

and where close to, or as a part of, the mechanism pivotally connecting the upper and lower section, means are provided for attaching front wheels, said wheel mounting being pivotable about a vertical axle;

where means are provided for slidingly attaching a seat to the upper chassis section, said means further comprising means for pivoting the seat about a horizontal axis.

In this manner a very flexible and light wheelchair construction is provided where, by pivoting the upper section in relation to the lower section of the chassis, it is possible to adjust the height of the seat. Furthermore, as the height is adjusted it is possible to adjust the seat such that the seat-orientation with respect to the surface can remain constant irrespective of the height of the seating surface.

Furthermore, by also being able to slide the seat in relation to the chassis, it can be assured that the overall point of gravity for the wheelchair including the user will be between the front and rear wheel, whereby the safest construction is achieved. Furthermore, as the two parts of the chassis pivot in relation to each other a very cost efficient construction is achieved in that the traditional wheelchairs as described above usually have a number of telescopic means which need to be extended or retracted in order to compensate for the differences in height. The pivot joint between the two chassis sections thereby makes it possible to alter the elevation of the seat steplessly in relation to the surface.

The front wheels as well as the rear wheels are replaceable, such that for smaller users smaller rear wheels may be matched with smaller front wheels. In further embodiments of the invention the means for attaching the front wheels may also be height adjustable, such that one size front wheels may be used with different size rear wheels, simply by height adjusting the means for attaching the front wheels.

In a further advantageous embodiment the means for attaching the seat in a slidable and pivotable manner to the upper chassis section cooperate such that when the seat is tilted backwards in relation to the travelling direction of the wheelchair, the seat is moved forwards, for example by means of a rack and pinion device, gearwheel drive, worm gear, sliding eye around an axle driven by an actuator or the like, whereby the point of gravity is kept in position relative to the rear wheels' axis.

It is possible to tilt the seat including the backrest independently of the chassis, or the height adjustment of the chassis. In an especially advantageous embodiment of this mechanism a "weightless" adjustment is provided. It is known to provide gas actuated springs for helping in lifting the user during adjustments of the seat, but the springs are provided as standard members, which means that they never fit the user perfectly. For a wheelchair according to the invention which may grow with the user, this aspect is further aggravated.

In order to alleviate this the wheelchair may, in an embodiment of the invention be provided with a mechanism, by which mechanism only a very light gas spring member is necessary, such that a substantially weightless adjustment may be facilitated. This mechanism comprises an offset connection member, connecting the seat to the chassis, such that as the seat is lifted the member forces the seat upwards and forwards. At the same time a guiding plate having a slot attached to the chassis, the slot interacting with an engagement tap of the seat controls the movement of the rear part of the seat. This coordinated movement, does not offset the point of gravity due to the design of the connection member. It is possible, with a minimum of effort, to adjust the seats position with the user in the seat.

Again for safety reasons it is very advantageous that the back rest of the seat cooperates with the seating surface such that when the back rest is tilted backwards, for example if the user wants to take a nap or for other reasons, the seat section slides forwards whereby the point of gravity also is moved forwards and thereby kept between the rear and front wheels. As the back rest of the seat is coupled to the seat section by means which automatically move the seat in relation to the back rest, for example by a rack and pinion, gearwheel drive, worm gear or a sliding eye around a axle it is possible to either create the coupled movement of the back rest and the seating section manually or also in alternative embodiments to provide assistance by means of actuators, for example an electrical actuator, such that when the back rest is moved backwards, which also can be done electrically by means of step motors, the seat will automatically be pushed forwards as a reaction to the declining of the back rest. It is obvious that the opposite movement, i.e. that the back rest is put into a more upright position, also will cause the seat to slide back in the appropriate position in relation to the chassis and the point of gravity.

In a further advantageous embodiment the means for attaching the seat in a slidable and pivotable manner to the upper chassis section cooperate such that when the upper chassis section is pivoted relative to the lower chassis section about a horizontal axis, the means for attaching the seat correspondingly compensates by a sliding/pivoting movement such that the orientation of the seat's seating surface is maintained.

The relative pivotable movement between the two chassis sections causes the upper section to move upwards whereby the seat is tilted forwards. In order for the user not to slide off the seat, the invention in a further advantageous embodiment as described above provides for compensation for this movement by tilting the entire seat including the back rest in relation to the pivotable movement. For example, if the height is increased, i.e. that the two chassis sections' relative position is widened such that the upper section will be further away from the lower section, the seat will tilt forwards and the user will have a tendency to slide off the seat. In order to alleviate this the seat, i.e. the back rest and the seating surface, will tilt backwards and a sliding movement backwards of the seat in relation to the point to which the seat if fixed to the chassis will also occur in order to maintain the point of gravity in a constant position between the rear and front wheels.

Correspondingly, once the upper chassis section is lowered in relation to the lower chassis section the user would, if no adjustments occurred, feel that the seat was tilted backwards. In order to compensate for this, the seat will as a response to the lowering of the upper chassis section tilt forwards in conjunction with a sliding movement of the seat in relation to the point where it is fixated to the chassis.

In a further advantageous embodiment the means for attaching the seat in a slidable and pivotable manner to the upper chassis section comprises two separate means;

- a first means for pivoting the seat, comprising a disc-shaped member to which a pivotal connection to the seat structure is provided such that the seating part and the backrest of the seat can pivot independently and that the disc-shaped member, is connected by an attachment arm to the upper chassis section;
- a second means for sliding the seat comprising a sliding axle adjacent both sides of the seat parallel and fastened to the load carrying members of the upper chassis section, and a sliding body arranged around said sliding axle and connected to the seat, and optionally a sliding dampening mechanism comprising a tooth rack arranged adjacent the sliding axle, cooperating with a loaded gearwheel arranged in the sliding body.

The disk-shaped member is offset fixed to the attachment means such that as the upper and lower chassis sections are moved relative to each other, the disk will perform an offset rotation. Hereby is achieved that the adjustment of the seat in relation to the movement of the chassis sections as discussed above to a large extend will be one movement in that by pivoting the seat the seating surface will be angled back into the original position in relation to the ground as a consequence of the relative movement of the two chassis sections and at the same time the point of gravity, due to the offset rotation of the attachment point to the disk, will provide a slight sliding movement.

The pivot point of the backrest is substantially superposed the users hip joint, such that the positioning of the back rest in relation to the users back and other features of the wheelchair remains in a constant relative relationship to the user.

In order to provide a through-sliding movement of the seat in relation to the chassis, the second means for sliding the seat are provided. Again by sliding the seat on two independent axles parallel to the chassis' load carrying members, the seat will be able to move backwards and forwards in relation to the intended travel direction. The arrangement can be provided with dampening means such that the sliding movement will not be experienced as one sudden movement or a number of abrupt movements, but will be felt by the user as a gentle slide forwards. Furthermore, if assistant means are provided, for example in the form of actuators, the dampening means will improve the controllability of the sliding movement.

As already mentioned above, the wheelchair according to the invention can in a further advantageous embodiment have means for maintaining the relative position between the upper and lower chassis sections, the tilt of the seat, and/or the backrest of the seat, and/or the position of the seat is maintained by means of one or more extendable/retractable members as for example telescopic gas spring, telescopic electric actuation member or a combination of different means.

Basically, any form of means being able to perform the desired movement can be used, but practise has shown that especially telescopic gas springs and electric actuation members provide the desired results within a realistic economic frame work.

In order to provide energy for the assisting means, a source of energy may be provided, for example a battery, where the source of energy is mounted below the seat, said source of energy's point of gravity being between and in front of the rear wheels, and further that the means for maintaining the pivotable parts are remotely controlled, alternatively wirelessly controlled by means of a control unit, such that a relative pivotal movement between the chassis sections, automatically pivots and/or slides the seat, such that the seats orientation and point of gravity is maintained, and that the control unit also may override the pre-programmed dependencies and control the pivotal and/or sliding movement of the different parts independently, and further that all parts in the control system are connected by appropriate means, i.e. wires, transmitters, receivers and the like.

As discussed above, some users of wheelchairs are simply not able to walk or support their body weight and therefore end up in a wheelchair. Other users have handicaps which they partly can overcome by using a wheelchair. In order to control the wheel chair, however, it is advantageous that the user or an assistant can access control means for the different functions as described above such that the wheelchair can be brought into its most convenient position according to the situation at hand. Furthermore, by arranging the energy source in the shape of a battery centrally and as low as possible in the wheelchair construction without impeding the ability of the wheelchair to traverse obstacles, the overall point of gravity is kept as low as possible and therefore the wheelchair's stability is improved.

In cases where the user is dependent on the assistance of a helper the control means can advantageously be wireless. When the assistant has to move about the wheelchair in order to help the user, it can be advantageous not to have a wire connection to the control means arranged at different positions around the wheelchair. For the user of a wheelchair having a wireless control means it does not present a problem as the wireless control can be arranged in a holder close to or in easy reach of the user on the wheelchair itself.

The control means can advantageously be programmed such that for example when it is desired to lower the back rest of the seat, a sliding movement is also activated in order to maintain the point of gravity between the front and rear wheels. Also, other combined movements can be pre-programmed in connection with the control unit such that the largest degree of safety can be maintained. However, there may also be situations where it is desirable to override the pre-programmed or coupled movements and the control means should naturally provide the possibility to do so.

The invention also provides a footrest for a wheelchair as discussed above. The footrest, however, is an optional feature and does not necessarily need to be arranged in connection with the particular wheelchair as described above.

The footrest comprises

- an attachment bracket suitable for fastening the footrest to a front portion of a wheelchair's seat or support construction;
- a first longitudinal member connecting the attachment bracket to a footplate;
- said footplate may be detachably and/or slidingly attached to the longitudinal member;

special in that

- the longitudinal member is a telescopic member comprising a top end section and a bottom end section arranged coaxially, one inside the other;
- the bracket further comprises a first pivotal connection means to a top end section of the first longitudinal member;
- the foot plate is arranged on the bottom end section of the longitudinal member;
- the bottom end section of the first longitudinal member in its uppermost end is provided with a backwards pointing flange, which flange is pivotally connected to a connection member;
- the connection member in its opposite end comprises a second pivotal connection means for connecting the connection member to the bracket at a point on the bracket in front of the first pivotal connection means.

By having this arrangement where the member on which the footplate is mounted crossing a connection member adjacent the bracket it is achieved that when the footrest is pivoted in relation to the bracket's fixation point with for example a wheelchair, the footplate will be maintained at a constant distance from a fictive pivot point above the attachment point for the bracket. This is especially advantageous in that when a person is sitting in a wheelchair and wants to elevate the leg with traditional footrests pivoting about the attachment point, the distance between the knee of the user and the footplate will be shorter, whereas with the inventive footrest due to the telescopic character of the longitudinal member in connection with the connection members' action, the distance between the attachment point and the footplate will be expanded/retracted depending on the movement such that the approximate distance from the user knee to the footplate will remain constant and thereby the same level of comfort will be maintained throughout the movement.

In order to provide the desired movement of the footplate in relation to the attachment point, the longitudinal member having telescopic properties will pivot about a first pivot point and due to the attachment of the connecting member will be extended/retracted as discussed above. In a preferred embodiment in order to provide the most optimal movement of the telescopic longitudinal member the connection member is non-linear, preferably it is curved or S-shaped.

In a further advantageous embodiment, an alternative configuration of a footrest suitable to be mounted on the wheelchair as discussed above is special in that the footrest comprises

- an attachment bracket suitable for fastening the footrest to a front portion of a wheelchair's seat or support construction;
- a first longitudinal member connecting the attachment bracket to a footplate;
- said footplate may be detachably and/or slidably attached to the first longitudinal member;

special in that

- the first longitudinal member has a fixed length and is attached to the bracket above the brackets fastening to the wheelchair;
- a second longitudinal member is provided, and that the second longitudinal member is a telescopic member comprising a top end section and a bottom end section arranged coaxially, one inside the other;
- the bracket further comprises first pivotal connection means to top end sections of the longitudinal members;
- the footplate is arranged on the bottom end section of the first longitudinal member;
- the top end section of the second longitudinal member is fastened to the bracket below and behind in the travelling direction of the fastening point of the first longitudinal member.

In this embodiment of the invention, the footrest will move in a circular arch in relation to the fastening point on the bracket. The second longitudinal member is provided in order to dampen the movement and help lift the leg such that a user will experience a substantially weightless movement whether the footrest is in a substantially vertical position, or the footrest is in the substantially horizontal position.

In a further advantageous embodiment of this construction, the length from the first longitudinal member's connection point to the bracket and to the footrest substantially corresponds to the length of a user's tibia, and that the first longitudinal member's connection point to the bracket is arranged substantially corresponding to a user's knee joint. By providing these properties with relation to the first longitudinal member with respect to the connection points, and adjusting the length of the first longitudinal member according to the user's tibia, i.e. the distance from the knee joint to the heel bone, a substantially uniform support will be provided, regardless of the position of the footrest on the circular arch.

The invention furthermore concerns an armrest suitable for a wheelchair as described above. The armrest, however, is an optional feature for wheelchairs and can as such be attached quite easily to any wheelchair. It is often desired, especially when the back rest of the seat is reclined, to be able to compensate for the changed angle of the back rest such that the arm rest will maintain its substantially horizontal position. In order to be able to adjust the arm rest, the inventive arm rest according to the invention provides an arm rest which comprises

- a bracket for mounting the armrest to the wheelchair for example to the back-rest of the seat or part of the support structure adjacent the back-rest of the seat;
- a gear wheel or at least a section of a gearwheel is fixed onto the bracket;
- a carrying member substantially corresponding to the size of the armrest is pivotally connected to the bracket, and the carrying member is of a general inverted U-shape such that it may cover the gear wheel;
- an armrest locking/adjusting mechanism arranged in the carrying member, comprising one or more biased engagement taps for engaging the gearwheel, said taps being connected to a lever, for example by a wire/string arrangement, such that activation of the lever releases the taps' engagement with the gearwheel such that the carrying member can pivot about its connection point with the bracket.

The bracket can be attached to any back rest of any wheelchair or any chair for that matter and as a gear wheel or a section of a gear wheel is provided with engagement taps for locking the carrying member in relation to the fixedly mounted gear wheel, the arm rest substantially being the carrying member can in this manner be pivoted about the bracket and be maintained in a position by engagement of the engagement taps into the spaces in the gear wheel. In order to conceal the construction and at the same time provide a protection, the carrying member can advantageously be shaped as a U-shaped member such that the opening in the U is turned downwards, whereby the carrying member covers the gear wheel, the engagement taps and the adjustment mechanism.

In a further advantageous embodiment the carrying member may be covered by a shell, constituting the exterior surface of the armrest, and that said exterior surface may have any texture and/or any colour, be cushioned, be waterproof or any other suitable characteristic, and/or that the lever is arranged at the free end of the armrest and is shaped such that it is easily accessible from the side and front.

In this advantageous embodiment it is possible to design the arm rest such that it will match the wheelchair or other seat onto which it is supposed to the mounted and furthermore that the lever for activating, that is disengaging or engaging the engagement taps into the gear wheel, can be arranged at the free end of the arm rest such that a user being placed in the seat, whether it is a wheelchair or another seat, easily can gain access to this lever and thereby control the angle of the arm rest relative to the angle of the back rest of the seat.

As this type of wheelchair often is provided with a number of facilities which are especially suited for the user, i.e. which provide special support or special services in relation to the handicap of the user, it can be advantageous to be able to remove the seat for the chassis and utilise the seat in other situations. Therefore, in a further advantageous embodiment of the invention, the seat construction including the sliding and tilting mechanism and all optional accessories such as among others actuators, gas-springs, telescopic means, electric control means can be detached from the chassis, and optionally mounted in a vehicle such as a train, bus, aircraft, boat or car, wherein attachment means corresponding to the attachment means between the seat construction and the chassis are provided, and further an optional access to a source of energy may be provided.

In this manner the user of the wheelchair can by providing simple brackets, for example in the bottom of a car, be moved with the seating portion of the wheelchair from the wheelchair chassis and onto the car and still be provided with all the amenities of the wheelchair as discussed above.

BRIEF DESCRIPTION OF THE DRAWING

FIG. 1 illustrates a side view of an embodiment of a wheelchair according to the invention.

DESCRIPTION OF THE EMBODIMENTS

Figure 4:
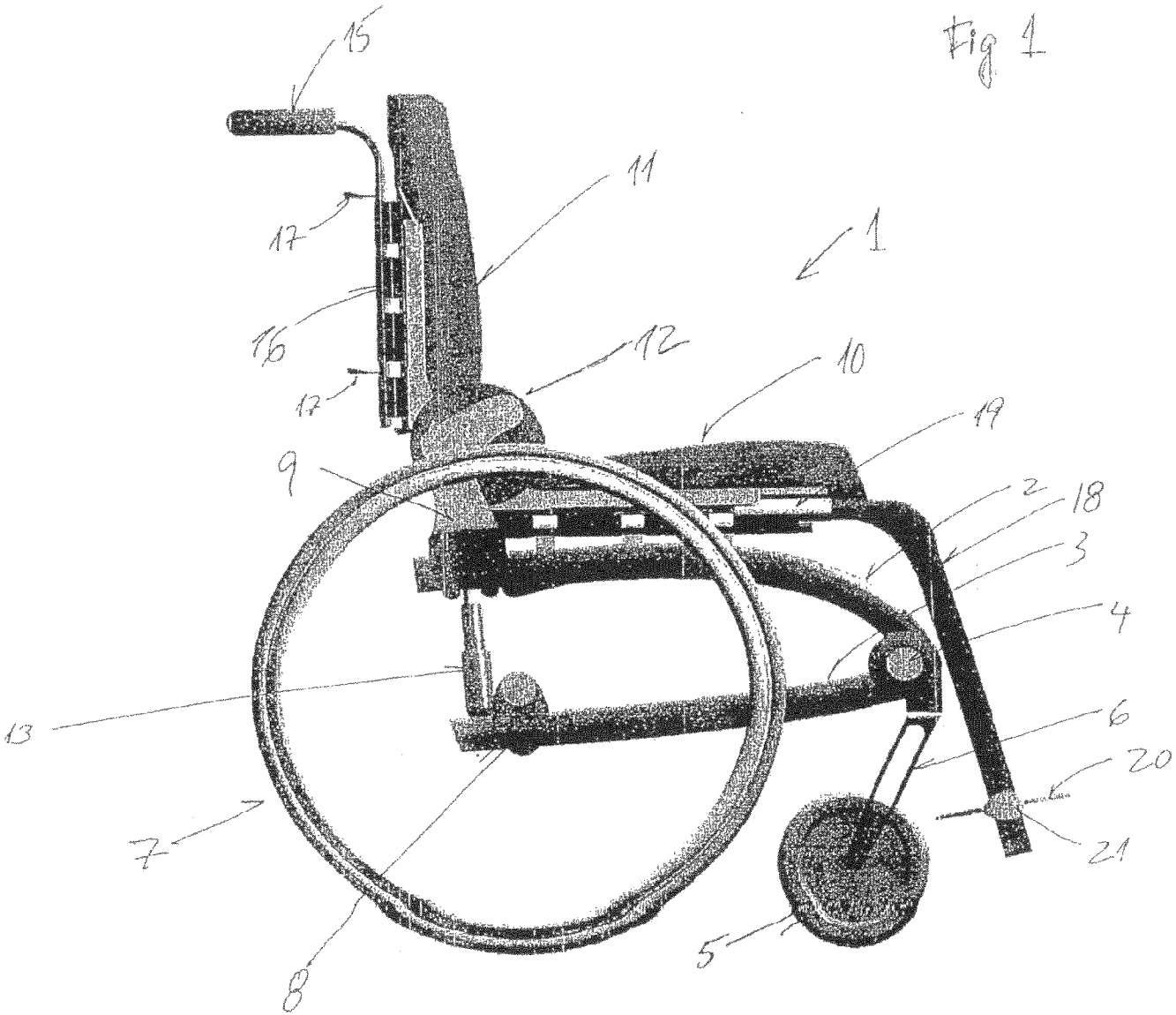
FIG. 4 illustrates a wheelchair in a reclined mode.

In FIG. 1 is illustrated a wheelchair 1 according to the invention. The wheelchair is basically constructed from a chassis comprising an upper chassis section 2 pivotally connected to a lower chassis section 3 by pivot means 4.

In the immediate vicinity of the pivot point 4 the front wheels 5 are arranged. The wheels 5 are connected by a connection member 6 to the chassis in such a manner that the connection member 6 can pivot about a vertical axis.

The connection member 6 may also pivot about the pivot point. The pivotal action is limited by appropriate fastening means (not illustrated) such that pivoting does not occur during normal use, but only when adjusting the wheelchair. The adjustment allows the same connection member to accommodate different wheel sizes, and/or by pivoting the connection member in relation to the rest of the chassis, compensate or adjust the front wheels to the size of the back wheels.

The rear wheels 7 are connected to the lower frame 3 by attachment means 8. The rear wheels can advantageously be fastened to the lower chassis section 3 by detachable means. Connected to the chassis by a connection member 9, the seat structure comprising a seating surface 10 and a back rest 11. The seating surface 10 and the back rest 11 may be connected to the seat attachment member 9 by means of a disk 12. The disk 12 is connected in an offset manner to the connection member 9 such that rotation of the disk 12 causes the seating surface 10 to move horizontally and possibly the back rest to recline or move into an upright position.

The back rest can be connected to the disk member such that the back rest may have any desired inclination in relation to the seating surface. As the backrest is connected and thereby also pivots about a point substantially superposed the users hip joint, all features of the wheel chair connected to the back rest remains at a constant position relative to the user, due to the arrangement of the pivot point superposed the hip joint.

In order to bring the seating surface into the desired level of elevation, the two chassis sections 2, 3 are pivoted relative to each other such that the distance between the two sections 2, 3 is either widened or lessened. In order to maintain the elevation of the seating section 10 in relation to the ground surface a telescopic member 13 is provided connecting the rear sections of the two chassis sections 2, 3.

Figure 2:
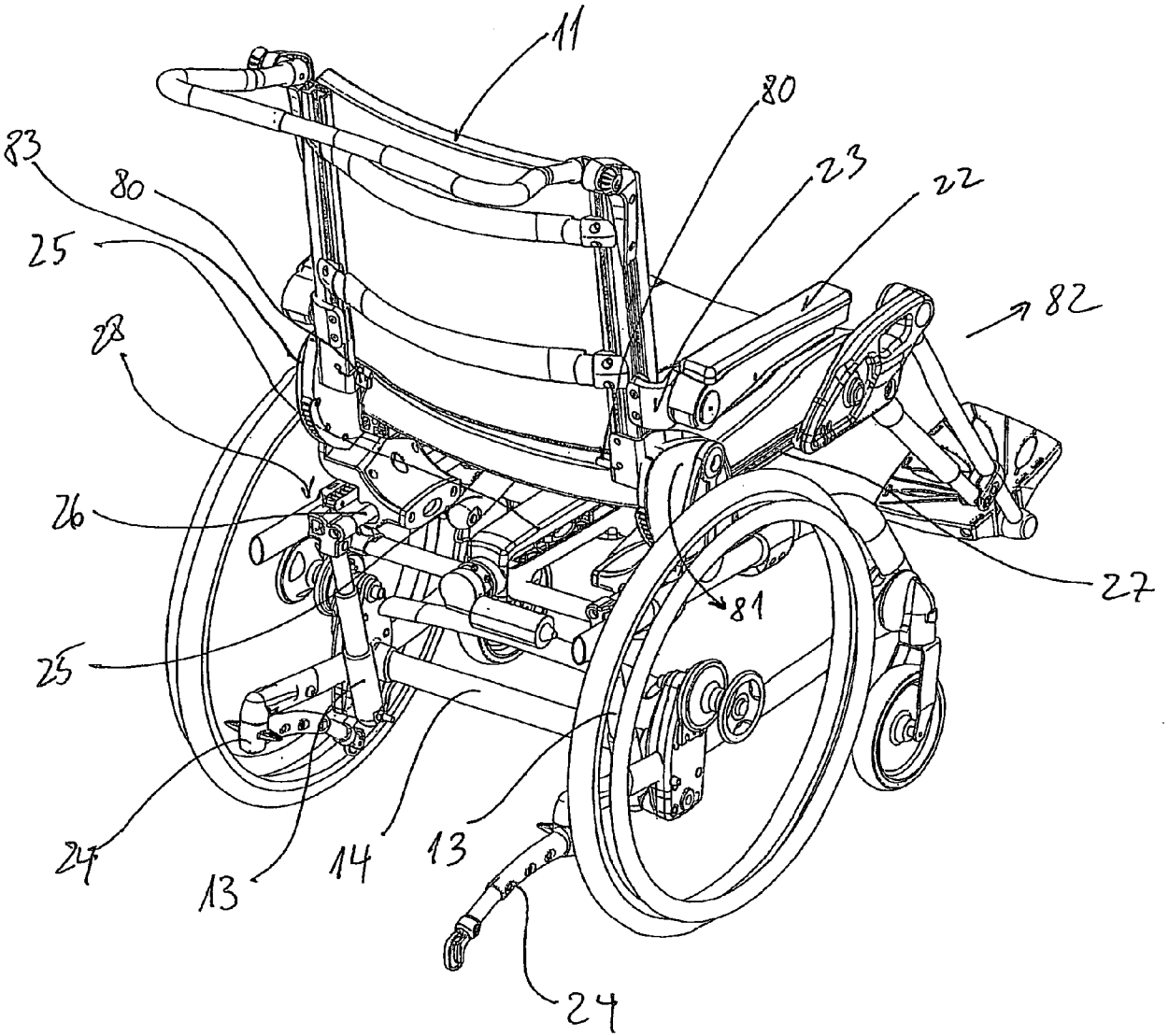
FIG. 2 illustrates a rear view of another embodiment of a wheelchair according to the invention.

The construction of the wheelchair as disclosed in FIG. 1 comprises upper and lower chassis members in either side of the wheelchair. The chassis sections in either side can be connected by at least one transverse member 14 as illustrated in FIG. 2. The telescopic means 13 may be connected from this transverse member to the bottom side of the attachment means for the seat, whereby only one telescopic member is needed.

In the further embodiment as illustrated in FIG. 2, two smaller telescopic members are provided. The illustrated wheelchair is further supplied with detachable push bars 15 which are detachably attached to the back of the back rest by the attachment means 16, for example in the shape of hollow cylindrical means into which the push bars 15 can be slit and kept in place by pins or other suitable simple fastening means.

Furthermore, a detachable footrest 18 is provided. The detachable footrest can for example be mounted by inserting a part of the footrest into a pipe 19 arranged on the seating section 10 of the wheelchair. The footrest is further supplied with a footplate 20 which by means 21 can be height adjusted.

Turning now to FIG. 2 where another embodiment of the wheelchair according to the invention is illustrated. Like features have corresponding reference number throughout the application. In this embodiment the wheelchair 1 is furthermore provided with armrests 22. The armrest 22 is attached to the back rest by means of a bracket 23. A further description of the construction of the armrest is made below with reference to FIGS. 10 and 11.

Figure 5:
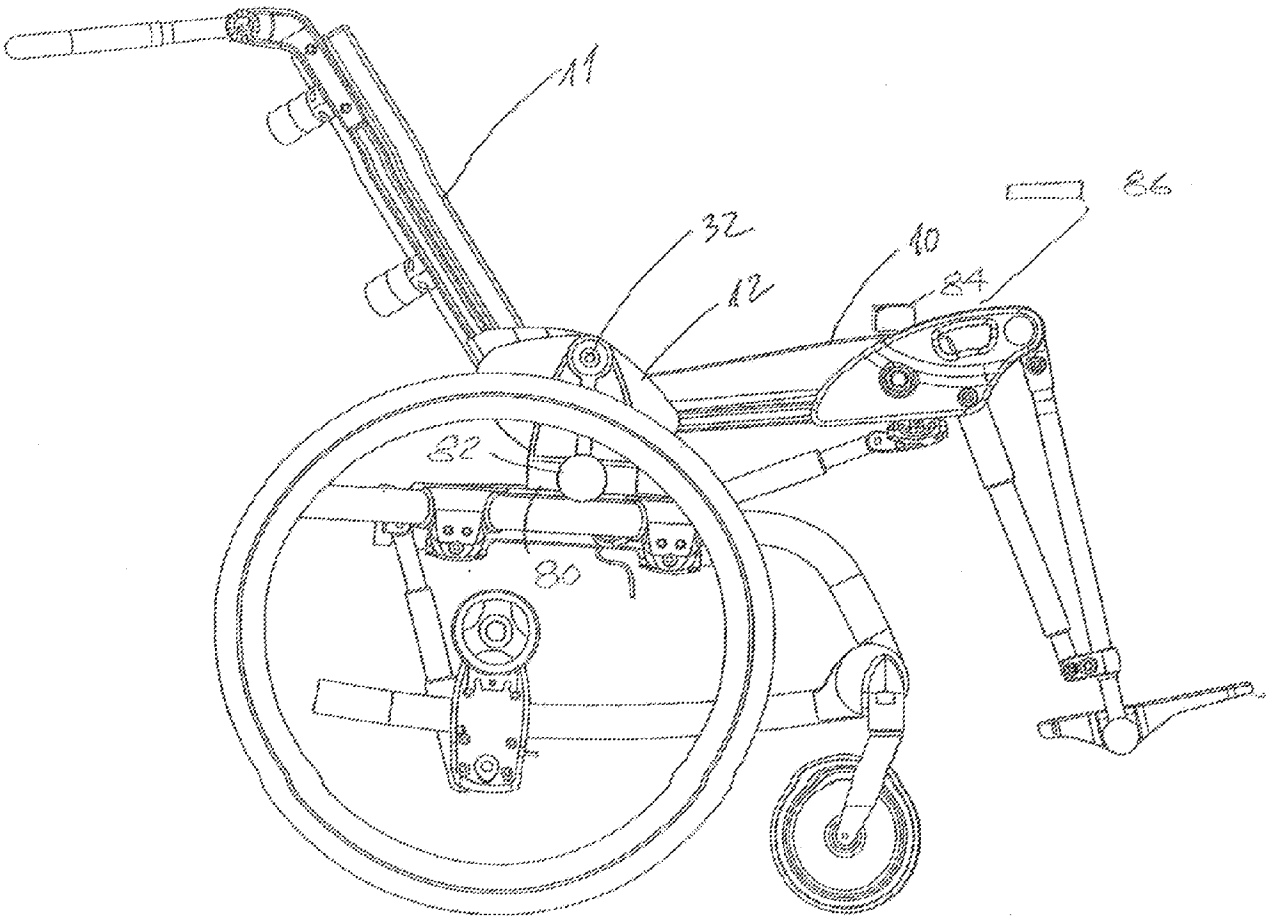
FIG. 5 illustrates a wheelchair in a tilted mode.
Figure 6:
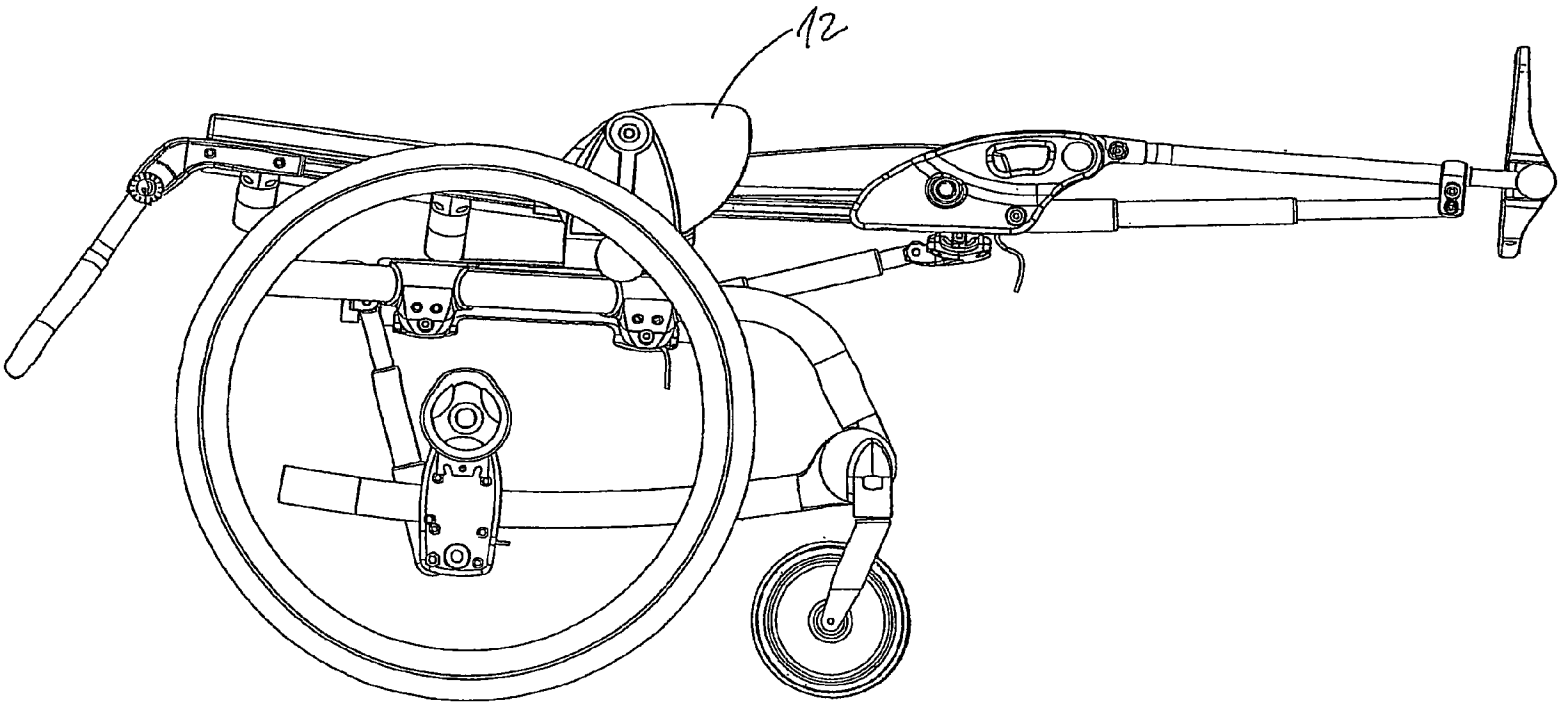
FIG. 6 illustrates a wheelchair in a fully reclined mode.

The wheelchair illustrated in FIG. 2 further has extra attachment wheels 24 which can be folded and extended as illustrated. These wheels offer an added security, especially in a situation where the user intends to tilt the seat backwards or recline the backrest 11 into a lying position as illustrated in FIG. 6. Furthermore, the illustrated embodiment is equipped with actuators 25, 26, 27. These actuators assist the user in sliding the seating section relative to the chassis. The actuator 25 furthermore aids in tilting the seat as illustrated in FIG. 5.

The attachment means 28 for attaching the seat to the chassis comprise in principle two separate means. The first means slide the seat relative to the chassis and a second means tilt the seat relative to the chassis.

The first means, i.e. the sliding means, can be a gear wheel which engages a tooth rack such that as the gear wheel is turned it will push the seat in relation to the tooth rack. Such an arrangement can be .provided at both sides of the wheelchair. Furthermore, by especially providing for example a round axle or another form of rail for the attachment means 28 to slide on, a very stable and safe movement of the seat in relation to the chassis will be achieved. In other embodiments of the invention the gear wheel can be provided with for example electric energy source 80, an electric step motor 82, whereby the sliding movement can be operated via a control box 84 and a remote control 86 which actuates the electrically driven step motor or any other form of electrical motor.

In the same fashion the means for tilting the seat in relation to the chassis can be arranged on a curved disk member comprising engagement means either in the shape of pins engaging apertures in the curved shaped member or as break pads engaging the curved members. In this way it becomes possible to tilt the seat into a desired position and maintain it in this position. Alternatively, a curved toothrack, see FIG. 3, can be provided which engages a gear wheel such that the actuation of the gear wheel will create a tilting movement in the seat either backwards or forwards. As explained above with reference to the sliding mechanism, the tilting mechanism can also be provided with electrical motor means such that the tilting movement can be controlled by a control box actuating the electrical motor means.

In embodiments where the wheel chair construction is not provided with all the means for motorised adjustment of the seat position, back position, etc., i.e. in embodiments where few or no actuators are provided, the back rest may be provided with a manual system, also illustrated in FIG. 2, for translating the position of the seat in relation to the wheel base, and the position of the back in relation to the seat. These means comprises tap 80, which are arranged in the back rest construction such that the end of the taps engages corresponding apertures provided in the holder 83. When the taps 80 are disengaged from the apertures provided in the holder 83, it is possible to move the seat in the direction indicated by the arrow 82, whereby the holder 83 will rotate following a curve generally indicated by the arrow 81. In this way, it is possible by manual/mechanical means to provide the wheel chair with the inventive features of displacing the seat in connection with tilting the back rest such that it is assured that the point of gravity is substantially arranged between the front, respectively rear, wheels of the wheel chair.

Figure 3:
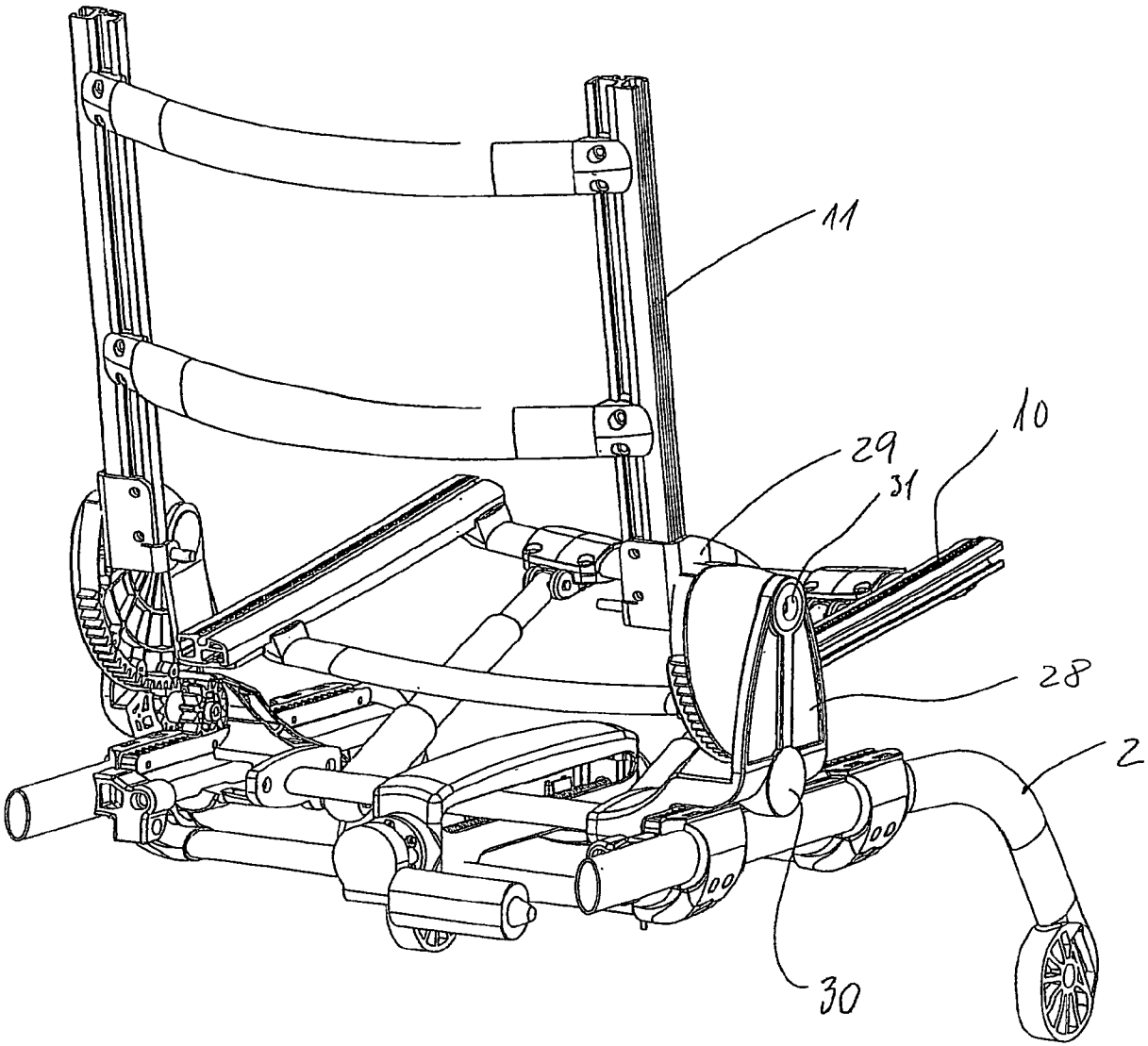
FIG. 3 illustrates a detail of a mounting arrangement.
Figure 4:
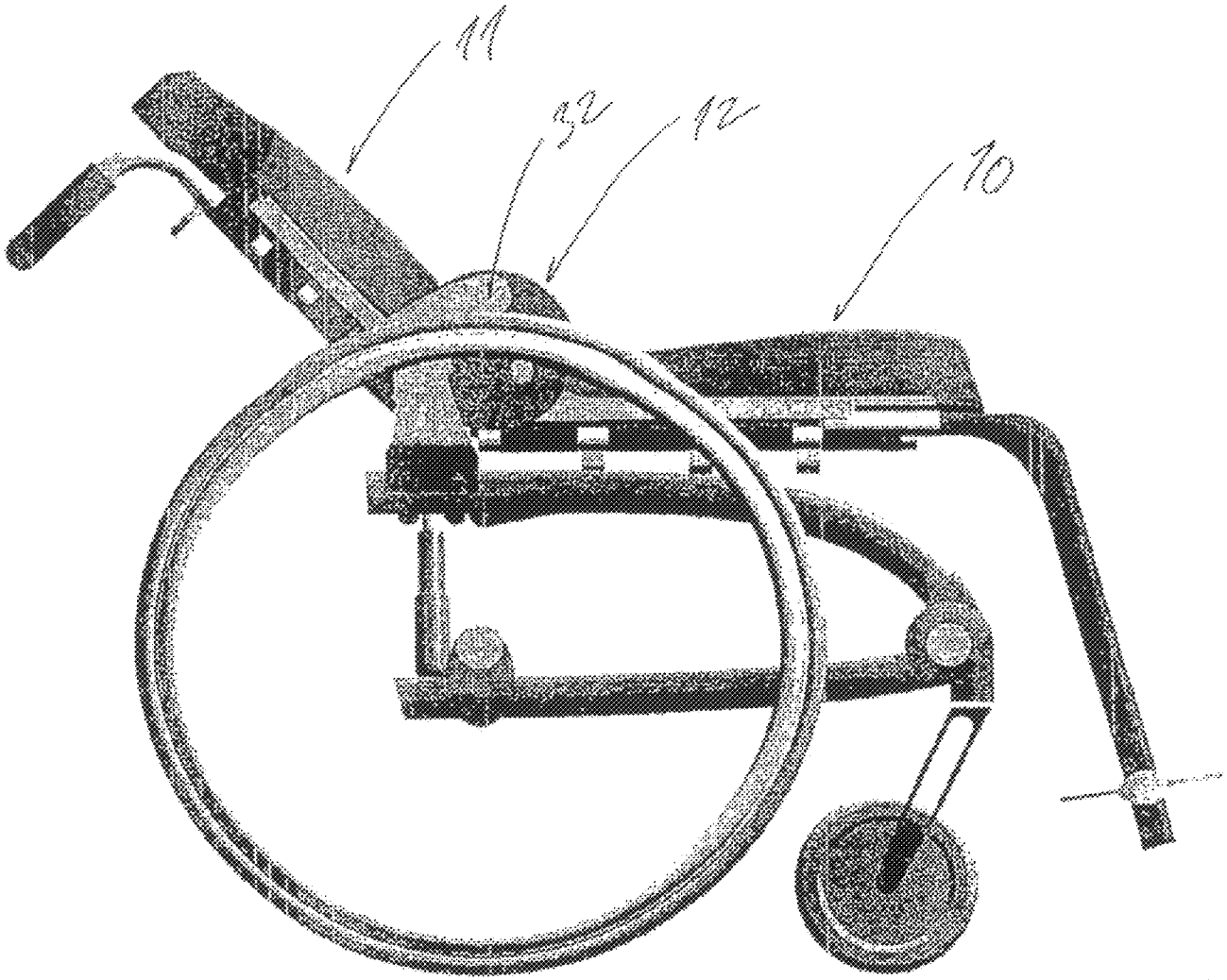

In FIG. 3 is illustrated a close-up view of the attachment means attaching the seat to the chassis. Also the bracket 29 attaching the back rest 11 to the seat is illustrated. In this embodiment of the invention the disk shaped member 12 is replaced by an attachment mechanism suitable for co-operation with the actuating means described above. Instead of having the disk mounted in an offset manner such that a tilting movement of the seat will create an uneven rotation of the disk whereby a combined sliding and tilting movement will be achieved, the attachment means 28 in this embodiment is simplified such that a double hinge is provided where the seating surface 10 will pivot about a first pivot point 30 and the back rest will pivot about a second pivot point 31 in response to actuation of actuators (not shown).

Figure 9:
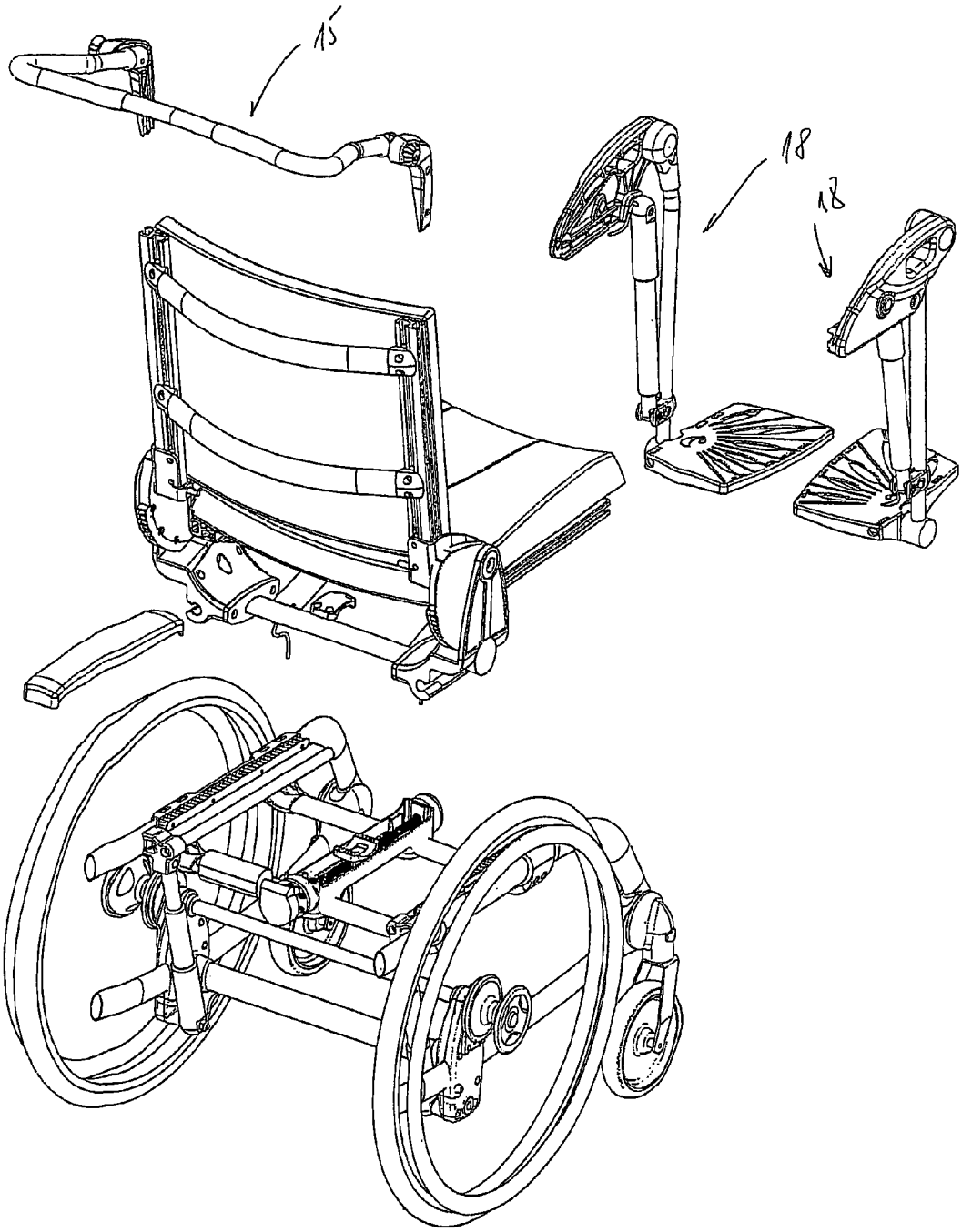
FIG. 9 illustrates a wheelchair where the seat section is detached from the chassis.

In one embodiment of the invention the seat can be detached from the chassis section such that the seat can be installed for example in a vehicle. This detachment is illustrated in FIG. 9. In one preferred embodiment the release button for detaching the seat from the chassis is arranged coincidental with the first pivot point.

Turning now to FIG. 4 a situation is illustrated where the back rest is reclined. This causes the disk 12 to rotate about the fixation point 32, whereby the seating surface 10 will be pushed forward. By bringing the back rest 11 back up into an upright position the seating surface will be pulled backwards. In this manner it is assured that the point of gravity during reclining of the back rest will be pushed forwards whereby the stability of the wheelchair as a whole can be maintained.

In FIG. 5 is a tilting movement of the seat in relation to the chassis illustrated. The relative position between the back rest 11 and the seating surface 10 is maintained, but due to the offset rotation of the disk 12 in relation to the attachment point 32, the entire seat will move slightly forwards due to this offset rotation. Again, this is done in order to maintain the point of gravity substantially between the wheels. However, it should be noted that the point of gravity, due to the very light construction of the wheelchair, will be dominated by the person placed in the wheelchair. In cases where the person using the wheelchair has a special weight distribution, for example caused by not having legs, the point of gravity will be heavily affected by this fact and it may therefore be difficult, even for the inventive wheelchair according to the invention, to maintain the overall point of gravity between the wheels. Therefore, in some situations the wheelchair can advantageously be equipped with stabilising arms and wheels 24 as illustrated in FIG. 2.

In FIG. 6 the wheelchair is illustrated in its fully reclined stage, i.e. the user will be substantially lying down. The seating surface has now been pushed into its foremost position due to the rotation of the disk 12.

Another important aspect of wheelchairs in general is their ability to be collapsed such that they easily can be stored, handled and carried. The wheelchair according to the invention can easily be collapsed and the wheels detached such that a minimum of space is required in order to store the wheelchair.

Figure 7:
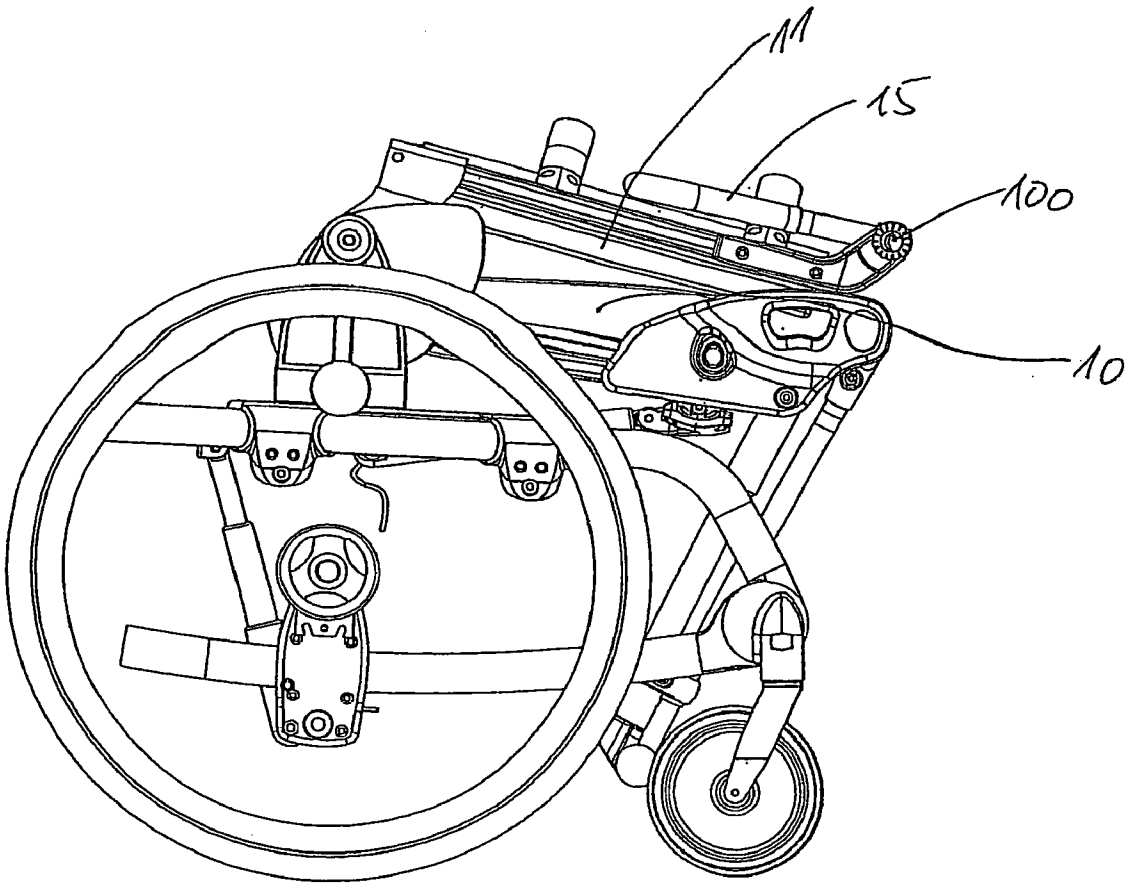
FIGS. 7 and 8 illustrate a wheelchair in a collapsed configuration.
Figure 8:
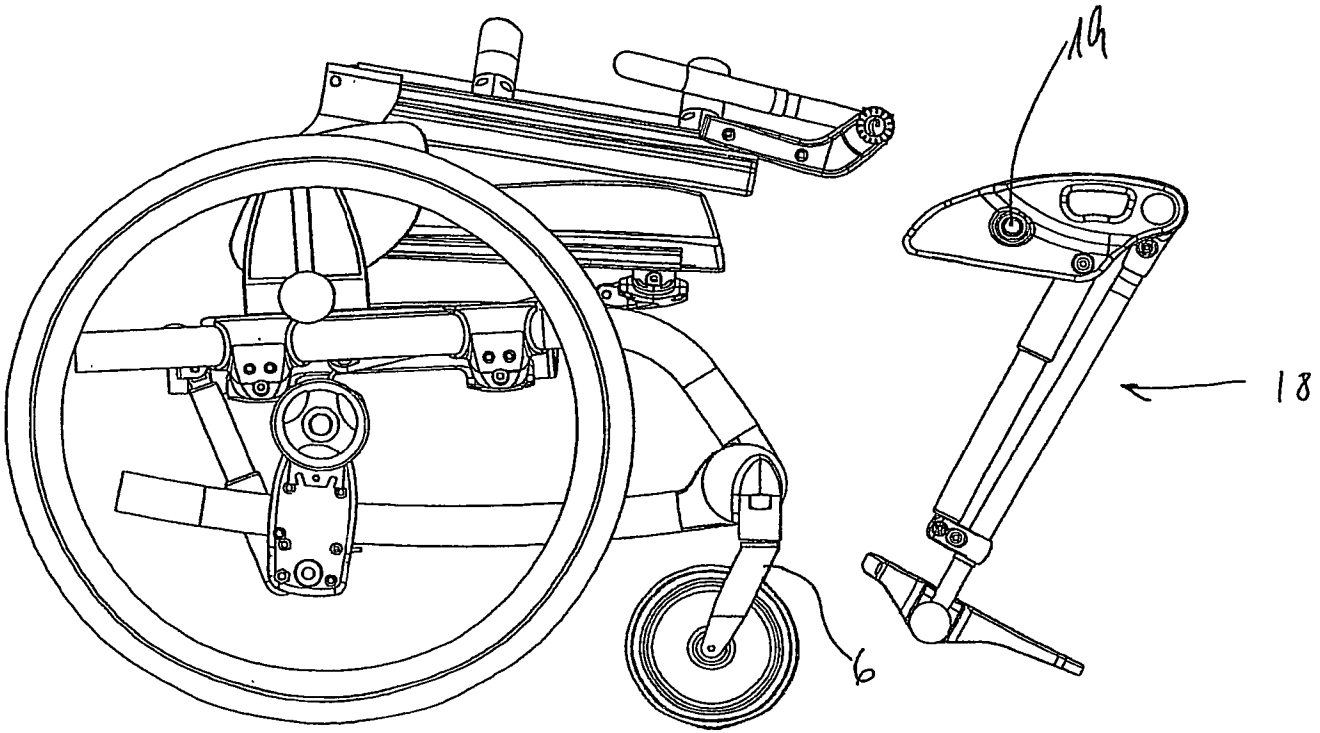

As illustrated in FIG. 7, first the back rest 11 is folded forwards onto the seating surface 10. Next the fastening means, for example pins, keeping the push bars 15 attached to the back rest are removed after which the push bars themselves are removed, or alternatively a hinge mechanism 100 is released whereby the handle bar 15 may be collapsed. The telescopic member 13 is withdrawn and the pivotable chassis members 2 are folded down into their lowermost position in relation to the lower chassis section 3.

The footrest 18 can also be detached from the holder 19 on the seating section. Appropriate fastening means can be used for fastening the pivotable connecting means 6 on the front wheels such that these easily can be removed from the chassis.

The wheels 7 may also be removed in a known manner.

In this manner the wheelchair will in its collapsed state take up a very limited space.

Furthermore, the wheelchair can in advantageous embodiments be manufactured from aluminium profiles, especially the chassis frames, the seating bearing structure, the wheels and the transverse members in particular.

The attachment points 4, 8, 9 and other suitable places can be made from a hard and strong plastic material such that the overall weight of the entire wheelchair is very light in comparison to traditional wheelchairs manufactured from a heavy steel construction. This makes it easier to handle the wheelchair, for example when it is to be stowed in the trunk of a car, in a cupboard or elsewhere.

In FIG. 9 the seat is illustrated in its detached state from the chassis structure.

Figure 10:
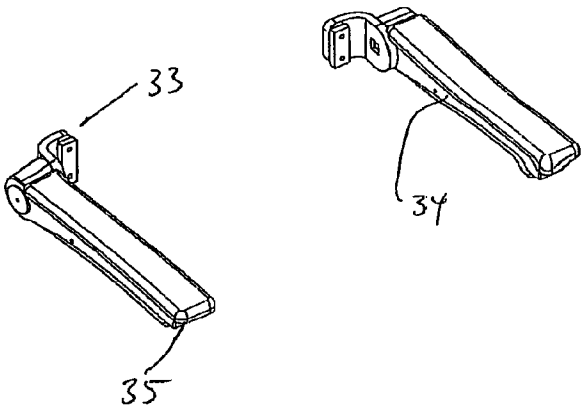
FIGS. 10 and 11 illustrate a detail of an armrest.

Turning to FIG. 10 an armrest according to the invention is illustrated. The armrest is in this embodiment mounted on the back rest 11 of the wheelchair according to the invention.

The mounting means is in the shape of a bracket 33 which may be attached by any appropriate means to the back rest, for example by screws, bolts or a special pin system can be provided. Attached to the bracket is the carrying member 34 which is able to pivot in relation to the bracket. The pivoting control mechanism will be explained with reference to FIG. 11, but in FIG. 10 the release lever 35 is illustrated as being pivotally attached to the free end of the arm rest, i.e. the end which is not attached via the bracket to the back rest.

Figure 11:
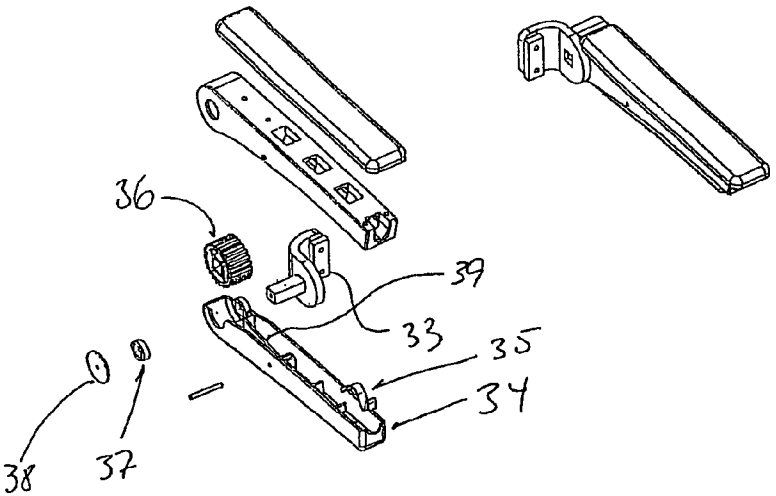
Figure 12:
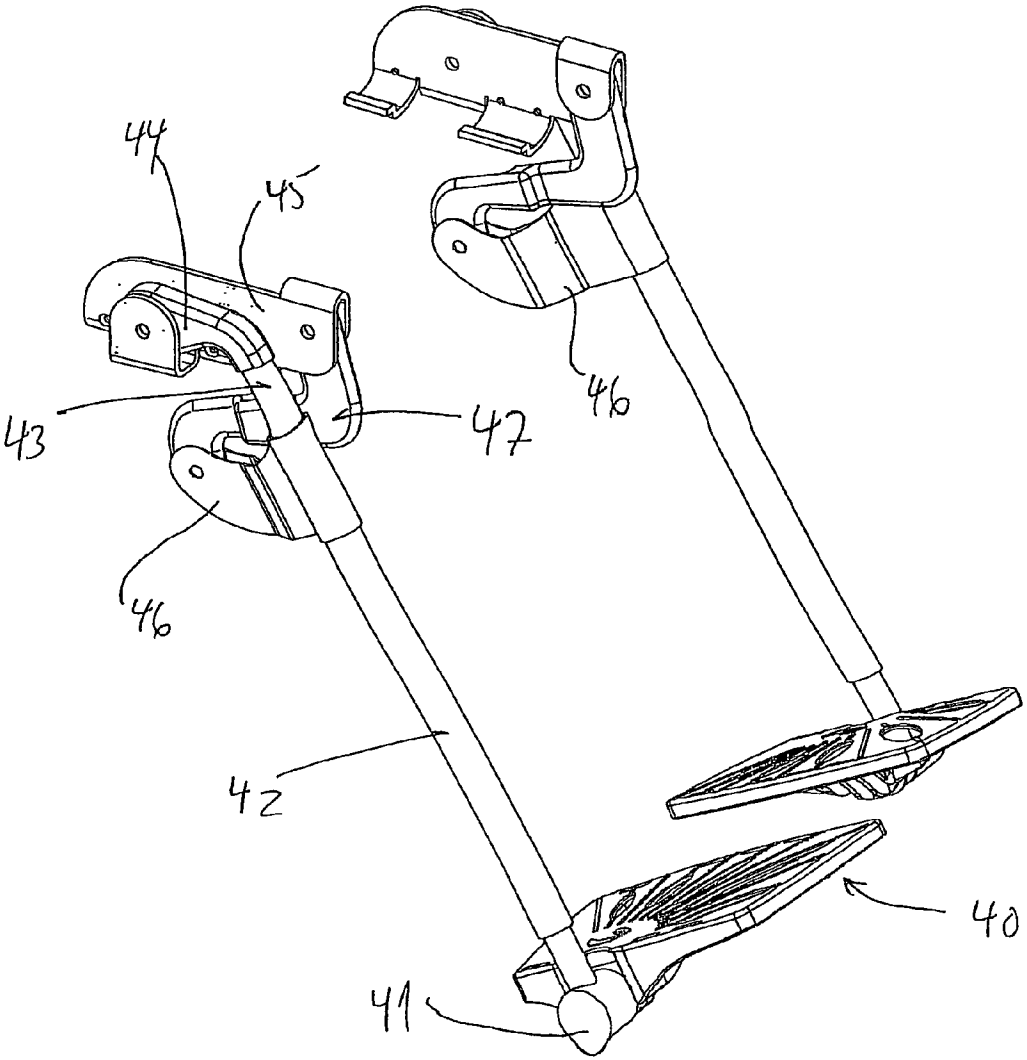
FIG. 12 illustrates a footrest system.

Turning now to FIG. 11 the mechanism for adjusting and keeping the arm rest in a desired position is illustrated. In comparison to the arm rest illustrated in FIG. 10 the carrying member 34 has been removed in order to expose the gear wheel 36 attached to the mounting bracket 33. Engagement taps 37 are provided such that the taps are mounted in an axle placed in the carrying member 34 and the free end of the tap can engage the gear wheel and thereby lock the carrying member in position in relation to the gear wheel. In order to keep the taps in engaged condition a biasing member, for example a spring 38 is provided.

In the embodiment of the invention where the activation lever 35 is mounted at the free end of the armrest, the engagement taps 37 are connected to the lever 35 by a wire string 39 such that by activating the lever 35, tension in the wire will cause the taps 37 to disengage the gear wheel whereby the armrest can be moved into any desired position. By releasing the lever 35 the biasing means in the shape of the spring 38 will pull the engagement taps 37 back into engagement with the gear wheel 36 and maintain this engagement until the lever is activated again. Thereby the armrest is kept in the desired position.

The invention is also directed towards a footrest suitable to be mounted on a wheelchair as described above.

The footrest is suitable for one foot only and in the situation where two footrests are needed, a mirror image footrest will be mounted in the opposite side of the wheelchair. The footrest consists of a footplate 40 detachably and adjustably mounted by appropriate means 41 to the bottom end section 42 of an elongated telescopic member. The top end section 43 of the elongated telescopic member is pivotally attached by first pivotable connection means 44 to the mounting bracket 45. On the side of the bottom end section 42 of the telescopic member pointing backwards in relation to the mounting on the wheelchair is arranged a flange member 46. Between the free end of the flange and the front end of the bracket 45 is provided a connection member 47 which can pivot in relation to the bracket and the flange 46. In this manner the footrest is mounted to the bracket by means of two attachments which cross each other such that when the footplate 40 is pivoted in relation to the seating surface on the wheelchair, the telescopic member will retract/extend depending on the movement. By this movement it is assured that the distance between the user's knee and the footplate is kept substantially constant such that the footplate will be able to support the user's feet throughout the entire pivotal movement.

The connection member 47 connects the free end of the flange 46 with the front end of the mounting bracket 45 and can have any suitable shape. In the illustrated embodiment the connection member 47 has an S-shape in that this particular shape has proven to provide an advantageous relative movement between the top end section 43 and the bottom end section 42 of the telescopic member.

Figure 13:
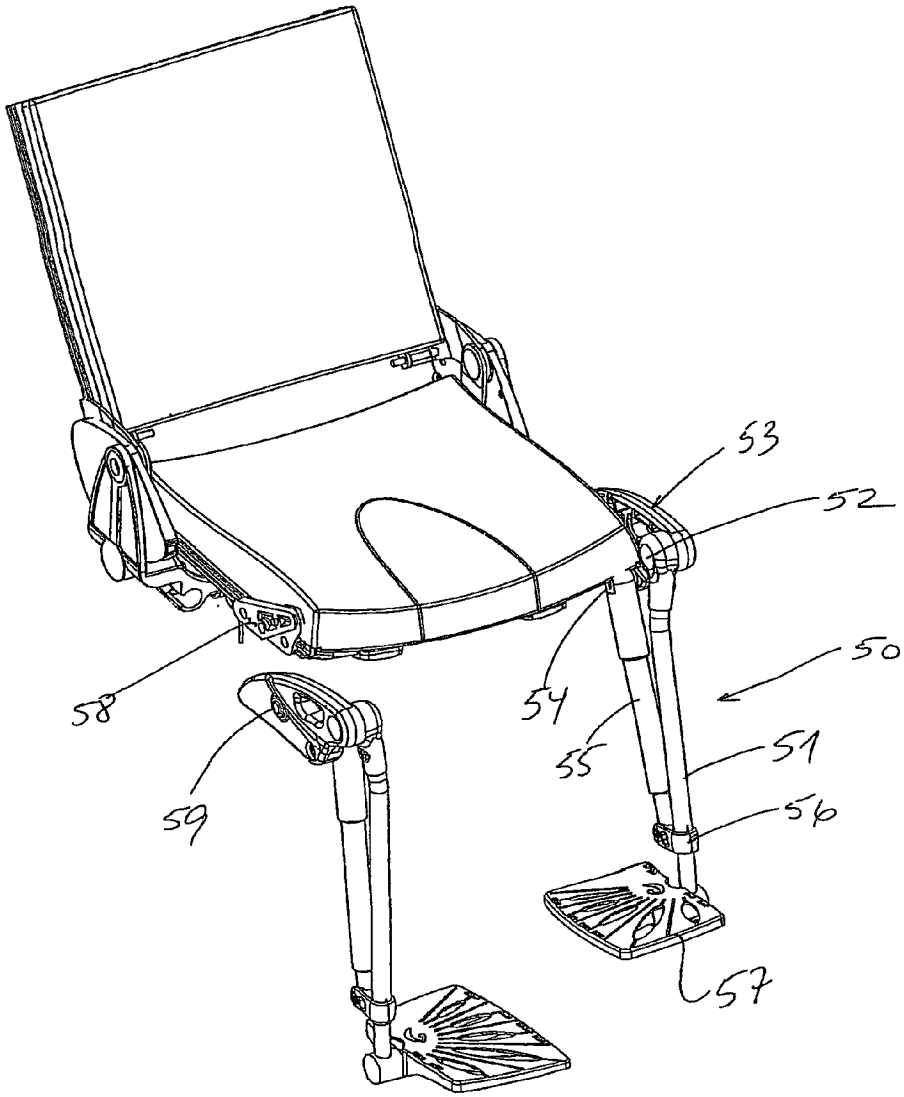
FIG. 13 illustrates a footrest system.

An alternative configuration of the footrest 50 is illustrated in FIG. 13. A first longitudinal member 51 having a fixed length is attached to a first pivot point 52. The pivot point 52 is arranged in a bracket 53 which is adapted to be fastened onto the chassis of the wheelchair. In the bracket at a position lower than the first pivot point 52, and rearwards of the first pivot point 52 (in relation to the wheelchair's travelling direction), a second pivot point 54 allowing a second longitudinal extendible member 55 to pivot is arranged. The second longitudinal member 55 is attached to the first longitudinal member 51 at a lower point 56. The footrest itself 57 is attached to the first longitudinal member 51 such that the angle of the footrest may be adjusted in relation to the longitudinal member 51. As the footrest 57 is brought in a circular arch by pivoting the first longitudinal member 51 around the first pivot point 52, the second longitudinal member 55 will extend and being a spring member it will aid in the movement, and keep the footrest 57 in position in a sort of weightless condition, i.e. the footrest will not move downwards due to gravity. This provides added comfort for the user. By this movement it is assured that the distance between the user's knee and the footplate is kept substantially constant such that the footplate will be able to support the user's feet throughout the entire pivotal movement.

On the chassis of the seat, a receiving bracket 58 is provided, whereby the bracket 53 may easily be attached and detached from this bracket 58 by, as illustrated, pushing the button 59.

Figures 14A, 14B:
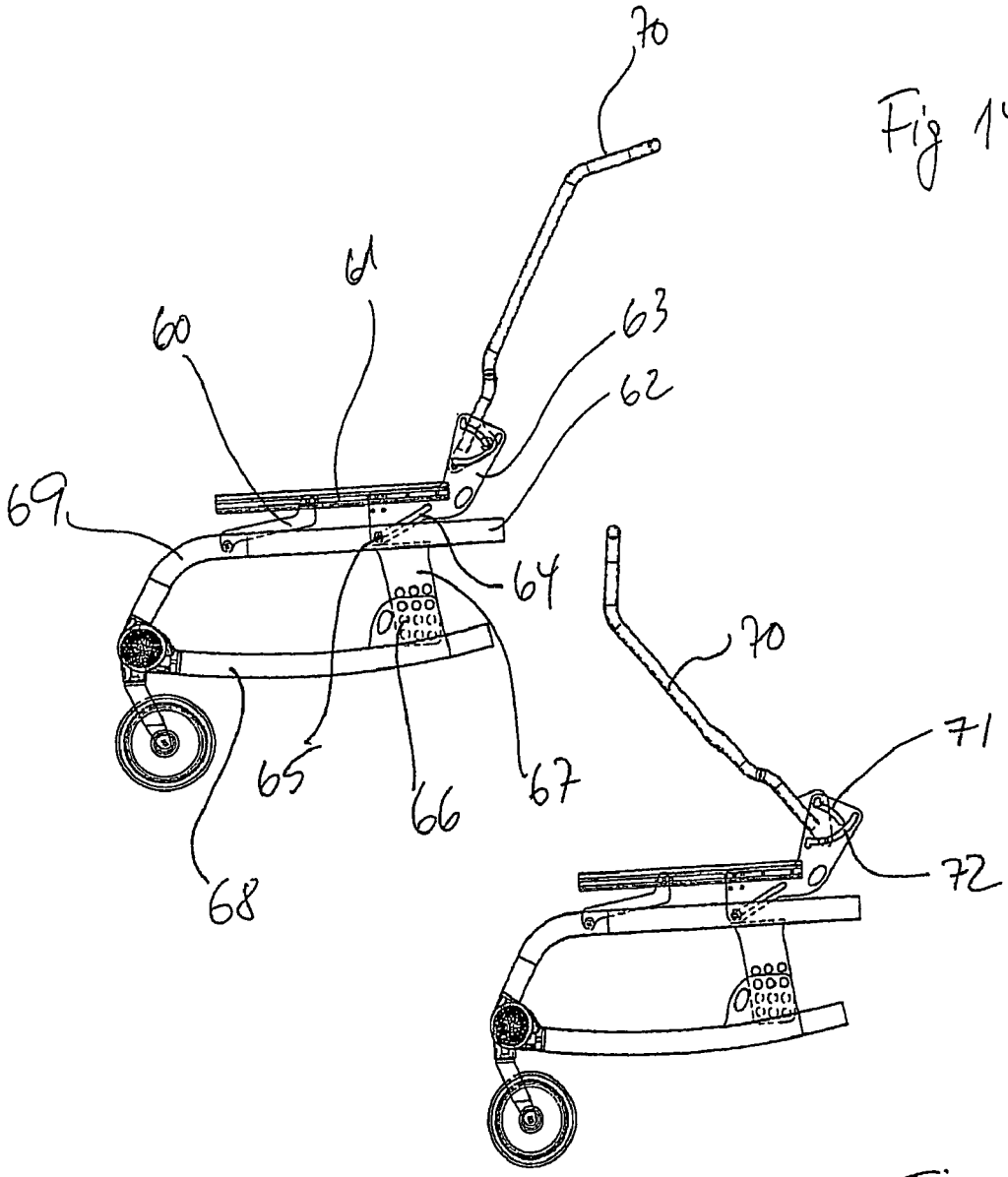
FIGS. 14*a* and *b* illustrate a mechanical "weightless" seat tilting mechanism.

The wheelchair may, in a further embodiment of the invention, as illustrated in FIGS. 14*a* and *b*, be provided with a mechanism, by which mechanism only a very light gas spring member is necessary, such that a substantially weightless adjustment may be facilitated. This mechanism comprises an offset connection member 60, connecting the seat 61 to the chassis 62, such that as the seat 61 is lifted the member 60 forces the seat upwards and forwards. At the same time a guiding plate 63 having a slot 64 attached to the chassis, the slot interacts with an engagement tap 65 of the seat, controls the movement of the rear part of the seat. This coordinated movement, does not offset the point of gravity due to the design of the connection member. It is possible with a minimum of effort, which may further be lessened by providing a gas spring (not illustrated), to adjust the seats position with the user in the seat.

The plates 66,67 serves in this embodiment to maintain the relative height between the to sections 68,69 of the chassis. The plates comprises holes such that by overlapping holes in the two plates and inserting a locking member the relative position of the two chassis frames 68,69 may be fixed, and at the same time easily adjusted.

The push bar 70 is in this embodiment integral with the back rest. By providing two curved slots 71,72 in the guide plate, it is relatively simple for a user to collapse the back rest and thereby the chair, such that it may fit in a confined space (car-boot, luggage compartment or the like). For safety reasons a safety hatch or other mechanism may be provided before collapse may be effectuated.

The invention claimed is:

1. A wheelchair comprising a chassis, which has a lower chassis section, an upper chassis section and means pivotally connecting the upper and lower chassis sections, such that the upper chassis section can pivot in relation to the lower chassis section about a substantially horizontal first axis;

where said lower chassis section comprises two substantially parallel load carrying members of the lower chassis section, oriented in a direction parallel to an intended travelling direction of the wheelchair;

where the two substantially parallel load carrying members are spaced in a direction perpendicular to the travelling direction by at least one transverse member which intersects each of the load carrying members;

means for detachably mounting rear wheels where the at least one transverse member intersects each of the load carrying members;

and where close to, or as a part of, the means pivotally connecting the upper and lower chassis sections, means for attaching front wheels are provided, said means for attaching the front wheels being pivotable about vertical axles;

means for slidingly attaching a seat in a slidable and pivotable manner to the upper chassis section said means for slidingly attaching the seat further comprising means for pivoting the seat about a second horizontal axis, wherein the means for slidingly attaching the seat in a slidable and pivotable manner to the upper chassis section comprises two separate means;

a first means for pivoting the seat, comprising a disc-shaped member to which a pivotal connection to the seat is provided such that the seating part and a backrest of the seat can pivot independently, and that the disc-shaped member is connected by an attachment arm to the upper chassis section;

a second means for sliding the seat comprising a sliding axle adjacent both sides of the seat parallel and fastened to load carrying members of the upper chassis section, and a sliding body arranged around said sliding axle and connected to the seat, and a sliding dampening mechanism comprising a tooth rack arranged adjacent the sliding axle, cooperating with a loaded gearwheel arranged in the sliding body;

wherein the means for slidingly attaching the seat in a slidable and pivotable manner to the upper chassis section cooperate such that when the upper chassis section is pivoted relative to the lower chassis section about said horizontal first axis, the means for slidingly attaching the seat in a slidable and pivotable manner correspondingly compensates by a sliding/pivoting movement such that an orientation of the seat's seating surface is maintained.

2. A wheelchair according to claim 1 further comprising a footrest, wherein the footrest comprises:

an attachment bracket suitable for fastening the footrest to a front portion of the wheelchair's seat;

a first longitudinal member connecting the attachment bracket to a footplate;

said footplate is detachably and/or slidingly attached to the first longitudinal member; wherein the first longitudinal member is a telescopic member comprising a top end section and a bottom end section arranged coaxially, one inside the other;

the attachment bracket further comprises a first pivotal connection means to a top end section of the first longitudinal member;

the foot plate is arranged on the bottom end section of the first longitudinal member;

the bottom end section of the first longitudinal member in its uppermost end is provided with a backwards pointing flange, which flange is pivotally connected to a connection member;

the connection member in its opposite end comprises a second pivotal connection means for connecting the connection member to the attachment bracket at a point on the attachment bracket in front of the first pivotal connection means.

3. A wheelchair according to claim 2, wherein the connection member is not linear, but is curved or S-shaped.

4. A wheelchair according to claim 3, wherein the length from the first longitudinal member's connection point to the bracket and to the footrest substantially corresponds to the length of a user's tibia, and that the first longitudinal member's connection point to the bracket is arranged substantially corresponding to a user's knee joint.

5. A wheelchair according to claim 1, wherein a relative position between the upper and lower chassis sections, a tilt of the seat, the backrest of the seat, or the position of the seat is maintained by one or more extendable/retractable members.

6. A wheelchair according to claim 5, wherein a source of energy is provided, where said source of energy is a battery, where the source of energy is mounted below the seat, a point of gravity of said source of energy being between and in front of the rear wheels, and further that the extendable/retractable members are remote controlled by means of a control unit such that a relative pivotal movement between the chassis sections automatically pivots and/or slides the seat, such that the seat's orientation and point of gravity is kept in position relative to the rear wheels' axis, and that the control unit also is configured to override pre-programmed dependencies, and control pivotal and/or sliding movement of different parts independently, and further that all parts in the control system are connected by wires or transmitters and receivers.

7. A wheelchair according to claim 3 where the wheelchair furthermore comprises an armrest, wherein the armrest comprises a bracket for mounting the armrest to the wheelchair for example to the backrest of the seat, or part of a support structure adjacent the backrest of the seat;

a gear wheel, or at least a section of a gearwheel, is fixed onto the bracket;

a carrying member substantially corresponding to the size of the armrest is pivotally connected to the bracket, and the carrying member is of a general inverted U-shape such that it covers the gear wheel;

an armrest locking/adjusting mechanism arranged in the carrying member, comprising one or more biased engagement taps for engaging the gearwheel, said taps being connected to a lever by a wire/string arrangement, such that activation of the lever releases the engagement of the taps with the gearwheel such that the carrying member can pivot about its connection point with the bracket.

8. A wheelchair according to claim 7, wherein the carrying member is covered by a shell constituting the exterior surface of the armrest, and that the lever is arranged at the free end of the armrest and is shaped such that it is easily accessible from the side and front.

9. A wheelchair according to claim 1, furthermore comprising a footrest wherein the footrest comprises:

an attachment bracket suitable for fastening the footrest to a front portion of the wheelchair seat;

a first longitudinal member connecting the attachment bracket to a footplate;

said footplate is detachably and/or slidably attached to the first longitudinal member; wherein the first longitudinal member has a fixed length and is attached to the attachment bracket above a fastening of the attachment bracket to the wheelchair;

a second longitudinal member is provided, and that the second longitudinal member is a telescopic member comprising a top end section and a bottom end section arranged coaxially, one inside the other;

the attachment bracket further comprises a first pivotal connection means to top end sections of the longitudinal members;

the footplate is arranged on the bottom end section of the first longitudinal member;

the top end section of the second longitudinal member is fastened to the bracket below and behind in the travelling direction of the fastening point of the first longitudinal member.

10. A wheelchair according to claim 1, wherein the means for slidingly attaching the seat in a slidable and pivotable manner to the upper chassis section cooperate such that when the seat is tilted backwards in relation to the intended travelling direction of the wheelchair, the seat is moved forwards by means of a rack and pinion device, gearwheel drive, worm gear, or a sliding eye around an axle driven by an actuator, whereby a point of gravity is kept in position relative to the rear wheels' axis.

11. A wheelchair comprising a chassis, which has a lower chassis section, an upper chassis section and means pivotally connecting the upper and lower chassis sections, such that the upper chassis section can pivot in relation to the lower chassis section about a substantially horizontal first axis;

where said lower chassis section comprises two substantially parallel load carrying members of the lower chassis section, oriented in a direction parallel to an intended travelling direction of the wheelchair;

where the two substantially parallel load carrying members are spaced in a direction perpendicular to the travelling direction by at least one transverse member which intersects each of the load carrying members;

means for detachably mounting rear wheels where the at least one transverse member intersects each of the load carrying members;

and where close to, or as a part of, the means pivotally connecting the upper and lower chassis sections, means for attaching front wheels are provided, said means for attaching the front wheels being pivotable about vertical axles;

means for slidingly attaching a seat in a slidable and pivotable manner to the upper chassis section said means for slidingly attaching the seat further comprising means for pivoting the seat about a second horizontal axis, wherein the means for slidingly attaching the seat in a slidable and pivotable manner to the upper chassis section comprises two separate means;

a first means for pivoting the seat, comprising a disc-shaped member to which a pivotal connection to the seat is provided such that the seating part and a backrest of the seat can pivot independently, and that the disc-shaped member is connected by an attachment arm to the upper chassis section;

a second means for sliding the seat comprising a sliding axle adjacent both sides of the seat parallel and fastened to load carrying members of the upper chassis section, and a sliding body arranged around said sliding axle and connected to the seat, and a sliding dampening mechanism comprising a tooth rack arranged adjacent the sliding axle, cooperating with a loaded gearwheel arranged in the sliding body;

wherein the seat construction including the means for slidingly attaching a seat and accessories, actuators, gas-springs, telescopic means, electric control means can be detached from the chassis, and mounted in a vehicle, wherein attachment means corresponding to the means for slidingly attaching the seat to the upper chassis are provided, and further an access to a source of energy is provided.

* * * * *